US005780767A

United States Patent [19]

Matsuda et al.

[11] Patent Number: 5,780,767

[45] Date of Patent: Jul. 14, 1998

[54] GAS GENERANT COMPOSITION

[75] Inventors: Naoki Matsuda; Norimasa Hirata; Shuzo Iyoshi, all of Hyogo, Japan

[73] Assignee: Daicel Chemical Industries, Ltd., Osaka, Japan

[21] Appl. No.: 580,433

[22] Filed: Dec. 27, 1995

[30] Foreign Application Priority Data

Dec. 27, 1994 [JP] Japan ..... 6-324815
Dec. 14, 1995 [JP] Japan ..... 7-325589

[51] Int. Cl.[6] ..... C06B 45/00

[52] U.S. Cl. ..... 149/2; 149/36; 149/109.4; 149/45; 149/75

[58] Field of Search ..... 149/35, 2, 36, 149/45, 61, 62, 75, 76, 78, 88, 89, 92, 108.2, 105, 109.4

[56] References Cited

U.S. PATENT DOCUMENTS

| | | | |
|---|---|---|---|
| 3,931,040 | 1/1976 | Breazeale | 149/26 |
| 4,696,705 | 9/1987 | Hamilton | 149/21 |
| 4,806,180 | 2/1989 | Goetz et al. | 149/5 |
| 4,994,212 | 2/1991 | Vos et al. | 149/35 |
| 5,051,143 | 9/1991 | Goetz | 149/3 |
| 5,431,103 | 7/1995 | Hock et al. | 102/287 |
| 5,516,377 | 5/1996 | Highsmith et al. | 149/18 |
| 5,529,647 | 6/1996 | Taylor et al. | 149/2 |
| 5,542,704 | 8/1996 | Hamilton et al. | 280/741 |
| 5,542,999 | 8/1996 | Bucerius et al. | 149/45 |
| 5,641,938 | 6/1997 | Holland et al. | 149/48 |

*Primary Examiner*—Joseph D. Anthony
*Attorney, Agent, or Firm*—Birch, Stewart, Kolasch & Birch, LLP

[57] ABSTRACT

Provided is a gas generant composition which is improved in the self-retainabiity of a solid residue and has an excellent combustion speed. The gas generant composition contains a fuel comprising a metal azide or an organic compound, an oxidizing agent, and at least one additive selected from a ceramic whisker or fiber of aluminum borate, potassium titanate, alumina, aluminum oxide, zirconium oxide, and zinc oxide.

2 Claims, No Drawings

GAS GENERANT COMPOSITION

BACKGROUND OF THE INVENTION

1. Field of the Invention

The present invention relates to a gas generant composition. More specifically, the present invention relates to gas generant composition which is suitable to a gas generator for a human body-protecting bag for protecting car passengers from an impact in a collision or a sudden stop of traffic facilities such as automobiles.

2. Description of the Related Art

In recent years, an air bag system in which a bag expands by detecting a collision in order to prevent passengers from being killed or injured by colliding against a handle part and glass is rapidly increasing in a demand therefor in the midst of further growing requirement of safety to automobiles.

In the air bag system, after detecting an impact, an igniting agent is ignited in an instant by electrical or mechanical means, and a gas generant is ignited by this flame and combusted to generate gas, whereby a bag is expanded. It is essential for such the gas generant to have a low impact ignitability and a high combustion speed. The impact ignitability means an ignition sensitivity to an impact, and if this is too sharp, an explosion risk increases, which is not preferred in terms of safety. Accordingly, the lower impact ignitability is preferred. On the other hand, the low combustion speed does not expand a bag in an instant and therefore is not useful for the air bag. A minute time of 20 to 30 milliseconds is required to the time consumed during a collision through completing the expansion of the bag. In order to meet the above requirement, the combustion goes on preferably at a speed of 40 mm/second when the combustion speed is measured under a pressure of 70 $kg/cm^2$. Further, with respect to the gas generant, resulting gas has to be harmless to human bodies, and a gas generating amount per unit weight has to be large.

The requirements described above lead to using mainly as a gas generant brought into actual use at present, substances containing, as a main component, metal azides such as sodium azide ($NaN_3$) generating nitrogen gas.

The gas generant composition described in U.S. Pat. No. 4,931,111 improves in the self-retainability of a solid residue by adding clay but has the defect that a large amount of clay is required in order to obtain a sufficient effect, which brings about a marked reduction in the combustion speed and a deterioration in the ignitability. The gas generant composition described in U.S. Pat. No. 4,696,705 enhances a scavenging effect of a solid residue by adding a graphite fiber and tries to improve a combustion speed. That requires a fiber length of 1 mm or more, which provides the defect that processability is notably reduced and a graphite fiber is very expensive.

Further, as can be seen in U.S. Pat. No. 4,376,002, and U.S. Pat. No. 5,143,567, $SiO_2$, $TiO_2$, $Al_2O_3$, and the like have been being used as slag-forming agents from the past. However, while all of them increase the viscosity of a residue and improve a scavenging performance by filters to some extent, they cause a great part of the residue to remain in a combustion chamber in the form of slug, and therefore lighter filters have not yet come to be possible. Further, the fixed amount or more has to be added in order to obtain an effect as the slug-forming agent, and in such case, a marked reduction in the combustion speed and the deterioration in an ignitability are brought about.

In view of the preceding problems on the prior arts, the subject to be solved by the present invention is to provide a gas generant composition which improves in the self-retainability of a solid residue and has an excellent combustion speed.

SUMMARY OF THE INVENTION

Intensive investigations made by the present inventors in order to solve the problems described above have resulted in completing the present invention.

That is, the present invention provides a gas generant composition containing a fuel comprising a metal azide or an organic compound, an oxidizing agent, and at least one additive selected from a ceramic whisker or fiber.

DETAILED DESCRIPTION OF THE INVENTION

The embodiments of the present invention will be explained below in details.

The metal azide used as the fuel of the present invention includes an azide of alkaline metal or alkaline earth metal, and sodium azide is particularly preferred.

The organic compound used as the fuel of the present invention includes at least one selected from the group consisting of metal salts of carbohydrazide such as magnesium carbohydrazide (MgCDH), nitroguanidine, 5-aminotetrazole, and dicyandimide (DCDA).

The oxidizing agent used in the present invention includes, when metal azides are used as the fuel, an oxidizing agent group I which comprises at least one selected from among iron oxide, cobalt oxide, and nickel oxide and which is liable to leave a solid residue while having a slow combustion speed, and an second oxidizing agent group II which comprises at least one selected from among copper oxide, manganese dioxide, molybdenum disulfide, nitrites, nitrates, and perchlorates and which scarcely leaves a solid residue while having a fast combustion speed. When organic compounds are used as the fuel, the oxidizing agent includes at least one selected from alkaline metal salts, alkaline earth metal salts or ammonium salts of nitric acid, nitrous acid chloric acid, or perchloric acid, or metal oxides, and potassium nitrate, strontium nitrate, or copper oxide is preferred. These oxidizing agents can be used either singly or in the mixture of two or more kinds.

The ceramic whisker or fiber used in the present invention includes whiskers or fibers selected from aluminum borate, potassium titanate, alumina, aluminum silicate, zirconium oxide, and zinc oxide. Preferably used are an aluminum borate whisker, a potassium titanate whisker, an alumina fiber, an aluminum silicate fiber, and a zirconium oxide fiber, and the aluminum borate whisker is particularly preferred. These whiskers or fibers have preferably a heat conductivity of 100 W/mK or less, a length of 5 to 500 μm, a diameter of 0.1 to 10 μm, and an aspect ratio of 3 to 2000. A whisker or fiber is short in a length and small in an aspect ratio, and a particulate one is notably reduced in a scavenging effect of a solid residue since it is not arranged in a steric network form. On the contrary, the too long length makes it difficult for the whisker or fiber to be evenly dispersed and causes problems in a mixing process and a molding process.

The contents of the fuel comprising the metal azide or organic compound, the oxidizing agent, and the ceramic whisker or fiber each contained in the gas generant composition of the present invention are preferably 50 to 75 weight % of the metal azide, 10 to 40 weight % of the oxidizing agent, and 3 to 30 weight % of the ceramic whisker or fiber, respectively, when the metal azide is used as the fuel, and preferably 5 to 60 weight % of the organic compound, 25 to 90 weight % of the oxidizing agent, and 3 to 30 weight % of the ceramic whisker or fiber, respectively, when the organic compound is used as the fuel.

The gas generant composition of the present invention can contain a binder such as a sodium salt of carboxymethyl cellulose.

The preferred embodiments of the gas generant composition of the present invention will be shown below:

1. a gas generant composition comprising (A) 50 to 70 weight % of the metal azide, (B) 20 to 40 weight % of at least one metal oxidizing agent selected from the oxidizing group I described above, and (C) 3 to 15 weight % of an aluminum borate whisker;
2. a gas generant composition comprising (A) 50 to 75 weight % of the metal azide, (B) 15 to 35 weight % of at least one metal oxidizing agent selected from the oxidizing group II described above, and (C) 5 to 30 weight % of the aluminum borate whisker;
3. a gas generant composition comprising (A) 50 to 75 weight % of the metal azide, (B) 3 to 35 weight % of at least one metal oxidizing agent selected from the oxidizing group I described above, (C) 1 to 25 weight % of at least one metal oxidizing agent selected From the oxidizing II group described above, and (D) 3 to 25 weight % of the aluminum borate whisker;
4. a gas generant composition comprising (A) 58 to 66 weight % of the metal azide, (B) 12 to 20 weight % of iron oxide, (C) 12 to 20 weight % of cobalt oxide, and (D) 5 to 10 weight % of a potassium titanate whisker;
5. a gas generant composition comprising (A) 58 to 66 weight % of the metal azide, (B) 10 to 30 weight % of copper oxide, and (C) 5 to 25 weight % of an aluminum silicate fiber;
6. a gas generant composition comprising (A) 58 to 66 weight % of the metal azide, (B) 20 to 30 weight % of manganese dioxide, and (C) 5 to 20 weight % of the aluminum silicate fiber;
7. a gas generant composition comprising (A) 58 to 66 weight % of the metal azide, (B) 24 to 32 weight % of iron oxide, (C) 3 to 12 weight % of sodium nitrite, and (D) 5 to 15 weight % of an alumina fiber; p1 8. a gas generant composition comprising (A) 58 to 66 weight % of the metal azide, (B) 24 to 32 weight % of iron oxide, (C) 3 to 12 weight % of sodium nitrate, and (D) 5 to 15 weight % of the alumina fiber;
9. a gas generant composition comprising (A) 58 to 66 weight % of the metal azide, (B) 5 to 15 weight % of iron oxide, (C) 15 to 25 weight % of copper oxide, and (D) 5 to 15 weight % of the alumina fiber;
10. a gas generant composition comprising (A) 20 to 40 weight % of MgCDH, (B) 5 to 20 weight % of DCDA, (C) 30 to 70 weight % of strontium nitrate, and (D) 3 to 15 weight % of at least one additive selected from the ceramic whisker or fiber;
11. a gas generant composition comprising (A) 5 to 25 weight % of DCDA, (B) 25 to 60 weight % of strontium nitrate, (C) 30 to 65 weight % of copper oxide, (D) 3 to 15 weight % of at least one additive selected from the ceramic whisker or fiber, and (E) 3 to 10 weight % of a sodium salt of carboxymethyl cellulose (a binder);
12. a gas generant composition comprising (A) 5 to 25 weight % of DCDA, (B) 30 to 70 weight % of potassium nitrate, (C) 20 to 40 weight % of copper oxide, and (D) 1 to 15 weight % of at least one additive selected from the ceramic whisker or fiber;
13. a gas generant composition comprising (A) 30 to 65 weight % of nitroguanidine, (B) 30 to 60 weight % of potassium nitrate, and (C) 3 to 15 weight % of at least one additive selected from the ceramic whisker or fiber;
14. a gas generant composition comprising (A) 30 to 65 weight % of nitroguanidine, (B) 30 to 60 weight % of strontium nitrate, and (C) 3 to 15 weight % of at least one additive selected from the ceramic whisker or fiber; and
15. a gas generant composition comprising (A) 30 to 65 weight % of nitroguanidine, (B) 35 to 65 weight % of copper oxide, and (C) 3 to 15 weight % of at least one additive selected from the ceramic whisker or fiber.

The gas generant composition of the present invention has the effects shown below:

(1) Solid products are scavenged on the ceramic whisker or fiber and coagulated, whereby the self-retainability of a solid residue is improved; the residue is shut in a combustion chamber to reduce a filter amount in an inflater; and therefore the inflater can be lightened.

(2) Ceramics are disposed in the gas generant composition in the form of a steric network by using a whisker- or fiber-formed substance, and the addition of a small amount thereof can effectively improve the self-retainability of the residue without reducing the combustion speed.

(3) Ceramics are easy to react with an oxide of alkaline metal or alkaline earth metal which is the main component of a solid product and have a high scavenging effect for the solid residue.

(4) The self-retainability of the solid residue can he improved without reducing the combustion speed by using the whisker or fiber having a relatively low heat conductivity. This is because the higher heat conductivity causes heat to be rapidly lost in combustion and leads to a reduction in the combustion speed.

(5) The cost is relatively inexpensive.

EXAMPLES

The present invention will be explained below in further details with reference to examples and comparative examples, but the present invention will not be restricted to these examples.

The definitions of the terms used in the examples are as follows:

Combustion speed

Combustion speed observed when a strand having a length of 12.7 mm is combusted under a pressure of 70 $kg/cm^2$.

Residue retainability

This is a value obtained by dividing the weight of a residue obtained after the combustion of the sample used in measuring the combustion speed with the weight of a solid matter which has to remain theoretically and converting it to the percentage. The larger residue retainability means that the less solid matter of the sample is scattered as the combustion goes on in measuring the combustion speed.

Mist

The value measured by a test (tank test) with an inflater.

Examples 1 to 4 and Comparative Examples 1 to 2

The gas generant compositions shown in Table 1 were prepared to measure the combustion speed and the residue retainability. The results thereof are shown in Table 1.

TABLE 1

| Gas generant composition (weight %) | Comp. Example 1 | Comp. Example 2 | Example 1 | Example 2 | Example 3 | Example 4 |
|---|---|---|---|---|---|---|
| $NaN_3$ | 64.0 | 64.0 | 61.0 | 61.0 | 61.0 | 61.0 |
| $Fe_2O_3$ | 16.0 | 32.0 | 15.2 | 15.2 | 30.4 | 30.4 |
| CoO | 20.0 | | 19.0 | 19.0 | | |
| $NaNO_2$ | | 4.0 | | | 3.8 | 3.8 |
| Aluminum borate whisker*1 | | | 4.8 | | | |
| Potassium titanate whisker*2 | | | | 4.8 | | |
| Alumina fiber*3 | | | | | 4.8 | |
| Zirconium oxide fiber*4 | | | | | | 4.8 |
| Combustion speed (mm/s) | 20.7 | 27.1 | 24.6 | 22.6 | 23.6 | 24.4 |
| Residue retainability (%) | 89.1 | 89.7 | 99.7 | 99.8 | 99.8 | 99.9 |

Remarks:
*1: Brand name Alborex manufactured by Shikoku Chemical Corporation; used was the substance prepared

Example 5 and Comparative Examples 3 to 4

The gas generant compositions shown in Table 2 were prepared to measure the combustion speed and the residue retainability. The results thereof are shown in Table 2.

TABLE 2

| Gas generant composition (weight %) | Comp. Example 3 | Comp. Example 4 | Example 5 |
|---|---|---|---|
| $NaN_3$ | 62.0 | 62.0 | 62.0 |
| CuO | 20.0 | 20.0 | 20.0 |
| Aluminum borate*1 (particle diameter: 30 μm) | 18.0 | | |
| Aluminum borate*1 (particle diameter: 8 μm) | | 18.0 | |
| Aluminum borate whisker*2 | | | 18.0 |
| Combustion speed (mm/s) | 22.2 | 26.7 | 33.9 |
| Residue retainability (%) | 99.9 | 95.4 | 99.0 |

Remarks:
*1: Brand name Alborite manufactured by Shikoku Chemical Corporation.
*2: The same aluminum borate whisker as that used in Example 1.

Examples 6 to 9 and Comparative Examples 5 to 7

The gas generant compositions shown in Table 3 were prepared to measure the combustion speed and the residue retainability. The results thereof are shown in Table 3.

TABLE 3

| Gas generant composition (weight %) | Comp. Example 5 | Comp. Example 6 | Comp. Example 7 | Example 6 | Example 7 | Example 8 | Example 9 |
|---|---|---|---|---|---|---|---|
| $NaN_3$ | 64.0 | 64.0 | 65.0 | 62.0 | 62.0 | 62.0 | 61.0 |
| $Fe_2O_3$ | 16.0 | 16.0 | 14.0 | 13.2 | 16.0 | 10.0 | 10.0 |
| CoO | | | 20.0 | 19.0 | 16.0 | | |
| $NaNO_2$ | | | 1.0 | 1.0 | 3.8 | | |
| $MnO_2$ | | 20.0 | | | | | 20.0 |
| CuO | 20.0 | | | | | 20.0 | |
| Aluminum borate whisker*1 | | | | 4.8 | 6.0 | 8.0 | 8.0 |
| Combustion speed (mm/s) | 30.6 | 32.0 | 25.4 | 29.8 | 26.3 | 45.5 | 35.5 |
| Mist | 6600 | 2100 | 1800 | 800 | 500 | 900 | 300 |

Remarks:
*1: The same aluminum borate whisker as that used in Example 1.

Examples 10 to 15 and Comparative Examples. 8 to 13

The gas generant compositions shown in Tables 4 and 5 were prepared to measure the combustion speed and the residue retainability. The results thereof are shown in Tables 4 and 5.

TABLE 4

| Gas generant composition (weight %) | Comp. Example 8 | Example 10 | Example 11 | Example 12 | Example 13 | Example 14 | Comp. Example 9 | Example 15 | Example 16 | Example 17 |
|---|---|---|---|---|---|---|---|---|---|---|
| MgCDH | 30 | 28.5 | 27.3 | 28.5 | 27.3 | 28.5 | | | | |
| DCDA | 13 | 12.4 | 11.8 | 12.4 | 11.8 | 12.4 | 13 | 12.4 | 12.4 | 12.4 |
| Nitroguanidine | | | | | | | | | | |
| $KNO_3$ | | | | | | | | | | |
| $Sr(NO_3)_2$ | 57 | 54.3 | 51.8 | 54.3 | 51.8 | 54.3 | 32 | 30.4 | 30.4 | 30.4 |
| CuO | | | | | | | 50 | 47.6 | 47.6 | 47.6 |
| CMC-Na*5 | | | | | | | 5 | 4.8 | 4.8 | 4.8 |
| Aluminum borate whisker*1 | | 4.8 | 9.1 | | | | | 4.8 | | |
| Potassium titanate whisker*2 | | | | 4.8 | 9.1 | | | | 4.8 | |
| Alumina fiber*3 | | | | | | 4.8 | | | | |
| Zirconium oxide fiber*4 | | | | | | | | | | 4.8 |

TABLE 4-continued

| Gas generant composition (weight %) | Comp. Example 8 | Example 10 | Example 11 | Example 12 | Example 13 | Example 14 | Comp. Example 9 | Example 15 | Example 16 | Example 17 |
|---|---|---|---|---|---|---|---|---|---|---|
| Combustion speed (mm/s) | 16 | 16 | 14.5 | 15 | 12.8 | 16.5 | 6.1 | 6.3 | 5.7 | 5.7 |
| Residue retainability (%) | 19 | 48 | 72 | 33 | 38 | 43 | 47 | 82 | 65 | 60 |

TABLE 5

| Gas generant composition (weight %) | Comp. Ex. 10 | Ex. 18 | Ex. 19 | Comp. Ex. 11 | Ex. 20 | Ex. 21 | Comp. Ex. 12 | Ex. 22 | Ex. 23 | Comp. Ex. 13 | 24 | 25 |
|---|---|---|---|---|---|---|---|---|---|---|---|---|
| MgCDH | | | | | | | | | | | | |
| DCDA | 19 | 18.1 | 18.1 | | | | | | | | | |
| Nitroguanidine | | | | 57.2 | 54.5 | 52.1 | 55.1 | 52.5 | 52.5 | 39.5 | 37.6 | 37.6 |
| $KNO_3$ | 51 | 48.6 | 48.6 | 42.3 | 40.8 | 39.0 | | | | | | |
| $Sr(NO_3)_2$ | | | | | | | 44.9 | 42.7 | 42.7 | | | |
| CuO | 30 | 28.5 | 28.5 | | | | | | | 60.5 | 57.6 | 57.6 |
| CMC-Na*5 | | | | | | | | | | | | |
| Aluminum borate whisker*1 | | 4.8 | | | 4.7 | 8.9 | | | | | 4.8 | |
| Potassium titanate whisker*2 | | | | | | | | 4.8 | | | | |
| Alumina fiber*3 | | | | | | | | | | | | 4.8 |
| Zirconium oxide fiber*4 | | | 4.8 | | | | | | 4.8 | | | |
| Combustion speed (mm/s) | 17 | 16.8 | 14.3 | 5.3 | 5.3 | 3.6 | 4.8 | 5.0 | 3.8 | 4.3 | 4.8 | 4.1 |
| Residue retainability (%) | 32 | 44 | 41 | 8.5 | 15 | 28 | 10 | 23 | 19 | 9 | 37 | 26 |

Remarks:
*1 to *4: the same as those described in Table 1.
*5: Carboxymethyl cellulose sodium salt.

What is claimed is:

1. A gas generant composition comprising a fuel source selected from the group consisting of an organic compound; an oxidizing agent; and at least one additive selected from the group consisting of a ceramic whisker and fiber, said additive having a heat conductivity of 100 W/mK or less, a length of 5 to 500 μm, a diameter of 0.1 to 10 μm, and an aspect ratio of 3 to 2000; and wherein one of the ceramic whisker or fiber is at least an aluminum borate whisker.

2. A gas generant composition comprising a fuel source selected from the group consisting of an organic compound; an oxidizing agent; and at least one additive selected from the group consisting of a ceramic whisker and fiber, said additive having a heat conductivity of 100 W/mK or less, a length of 5 to 500 μm, a diameter of 0.1 to 10 μm, and an aspect ratio of 3 to 2000; and wherein one of the ceramic whisker or fiber is at least a zirconium oxide fiber.

* * * * *